US005997339A

United States Patent [19]

Fuji et al.

[11] Patent Number: 5,997,339

[45] Date of Patent: Dec. 7, 1999

[54] CABLE CONNECTION

[75] Inventors: Hiroshi Fuji, Mishima; Hajimu Iwai, Takagata-gun, both of Japan; Fabio Righi, Atherton, Calif.

[73] Assignees: Digital Persona, Inc., Redwood City, Calif.; Omron Corporation, Kyoto, Japan

[21] Appl. No.: 08/970,494

[22] Filed: Nov. 14, 1997

[51] Int. Cl.[6] ..... H01R 13/56

[52] U.S. Cl. ..... 439/446

[58] Field of Search ..... 439/446, 165

[56] References Cited

U.S. PATENT DOCUMENTS

| | | | |
|---|---|---|---|
| D. 332,088 | 12/1992 | Nimpoeno et al. | D13/184 |
| 2,540,575 | 2/1951 | Finizie | 439/446 |
| 4,190,307 | 2/1980 | Eckart . | |
| 4,357,519 | 11/1982 | Bain, Jr. | 219/256 |
| 4,719,314 | 1/1988 | Nothnagel et al. | 174/65 R |
| 5,095,677 | 3/1992 | Godbout et al. | 52/648 |
| 5,676,568 | 10/1997 | Weber | 439/694 |
| 5,818,422 | 10/1998 | Kwon | 345/157 |

*Primary Examiner*—Gary F. Paumen

*Attorney, Agent, or Firm*—Blakely, Sokoloff, Taylor & Zafman LLP

[57] ABSTRACT

A method and apparatus for a cable connection system is provided. The connection system includes a cable termination coupled to the end of a cable. The cable termination includes a body and two substantially circular pivots, and a cable input in the body of the cable termination for receiving the cable. The cable termination is designed to fit rotatable into a device having a mating housing. The device includes a groove on both sides of the mating housing, for fitting the cable in either direction, such that the cable termination may be rotated into the mating housing in either direction.

20 Claims, 6 Drawing Sheets

CABLE CONNECTION

FIELD OF THE INVENTION

The present invention relates to an apparatus for coupling together components of a system, and more specifically, to cable connections.

BACKGROUND OF THE INVENTION

Cables are often used to couple together elements of a system. For example, cables are used to couple together computer components, form electrical connections between components, connect telephones to walls, etc. All of these connections use wiring encased in a non-conductive shell, for example plastic. Cable connectors are generally attached to the end of cables in order to permit the cable to be connected to another component.

An example of a prior art cable connection is shown in FIG. 1. A cable 110 terminates in a connector 120. The connector 120 is designed to interface with a socket 130. The socket 130 is part of a second device 140. The socket 130 receives the connector 120. Generally, the connector 120 can only be inserted into the socket 130 in one direction. That is, for example, if the second device 140 is to be turned around, the cable has to be looped around the second device 140. Furthermore, generally part of the connector 120 extends beyond the socket 130, requiring extra space.

One prior art method of solving this problem is including a second socket on the other side of the second device. However, including a second socket is redundant, and may be expensive to implement.

Another prior art method of solving this problem is to use thin cable, which may be bent underneath the device in a groove. However, this limits number of wires which may be included in the cable. Additionally, it places stress on the cable. Furthermore, repeated bending of the cable, from one direction to the other, may lead to wire breakage.

SUMMARY OF THE INVENTION

A method and apparatus for a cable connection system is provided. The connection system includes a cable termination coupled to the end of a cable. The cable termination includes a body and two substantially circular pivots, and a cable input in the body of the cable termination for receiving the cable.

The cable termination is designed to fit rotatable into a device having a mating housing. The device includes a groove on both sides of the mating housing, for fitting the cable in either direction, such that the cable termination may be rotated into the mating housing in either direction.

DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A cable connection is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

An apparatus for connecting a cable to a device is disclosed. The cable terminator receives a cable, and connects it to a device. The cable may be rotated by a large angle without imparting stress on the cable, the wires, or presenting mechanical resistance to the user. The wires are integral to the cable and exit a cable terminator along the axis of rotation. The wires couple a connecting piece to the device. The wires have sufficient loop to accommodate the necessary motion. This permits a cable to be coupled to a device in different orientations with different cable exit locations, for various configurations. This also allows the use of a stiff cable, that does not undergo flexure when changing cable exit locations. The mating housing 400 is substantially concave-down where the cable exists the device, and substantially concave up at the pivot points. This permits inexpensive molding or machining of the mating housing 400, simple assembly, and few pieces. The configuration of including a cable terminator 200 placed within a mating housing 400 is inherently stable, cheap, easily assembled, long lasting, and has few separate pieces.

Figure 1:
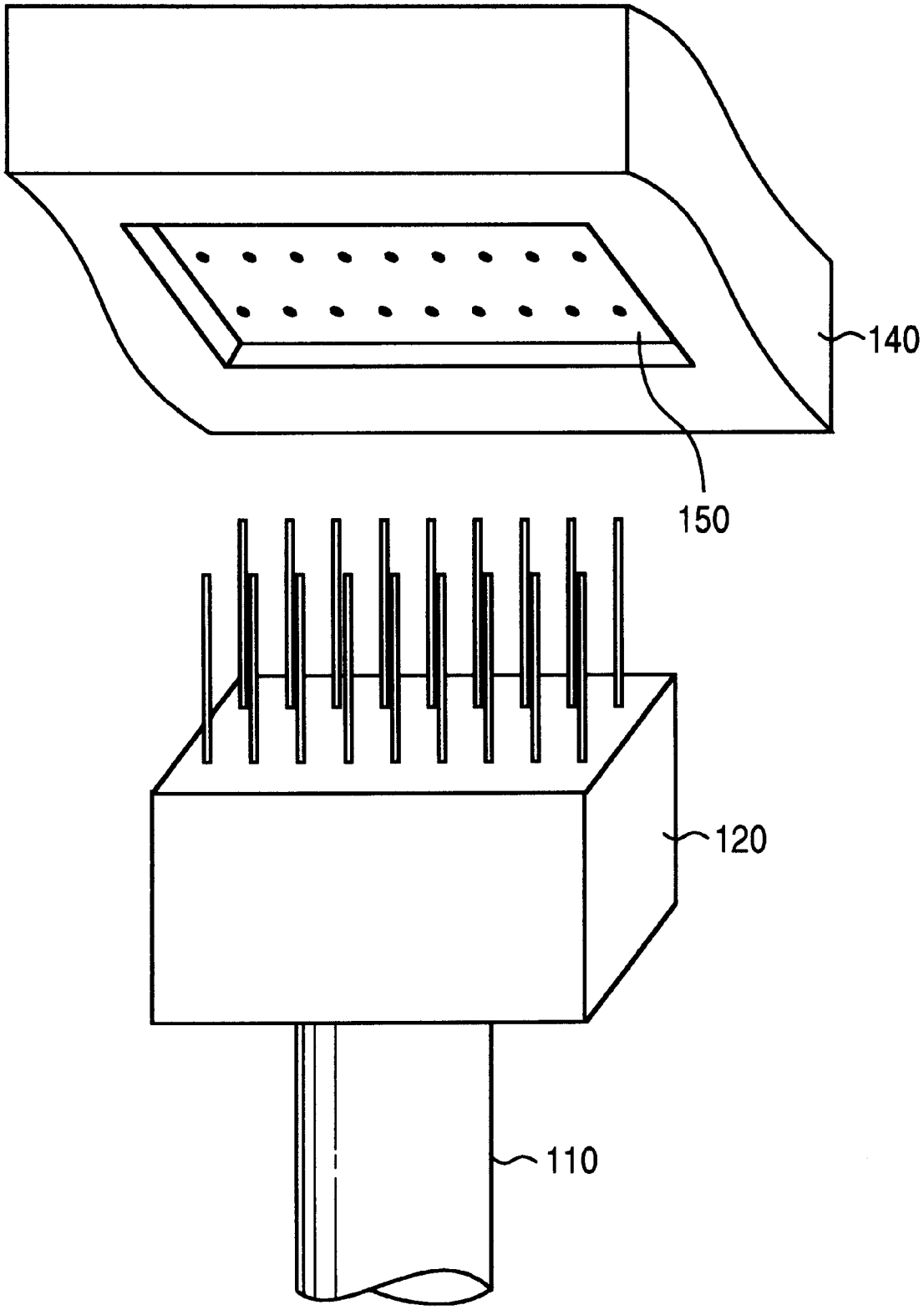
FIG. 1 (Prior Art)
FIG. 1 is a prior art cable connection system.
Figure 2:
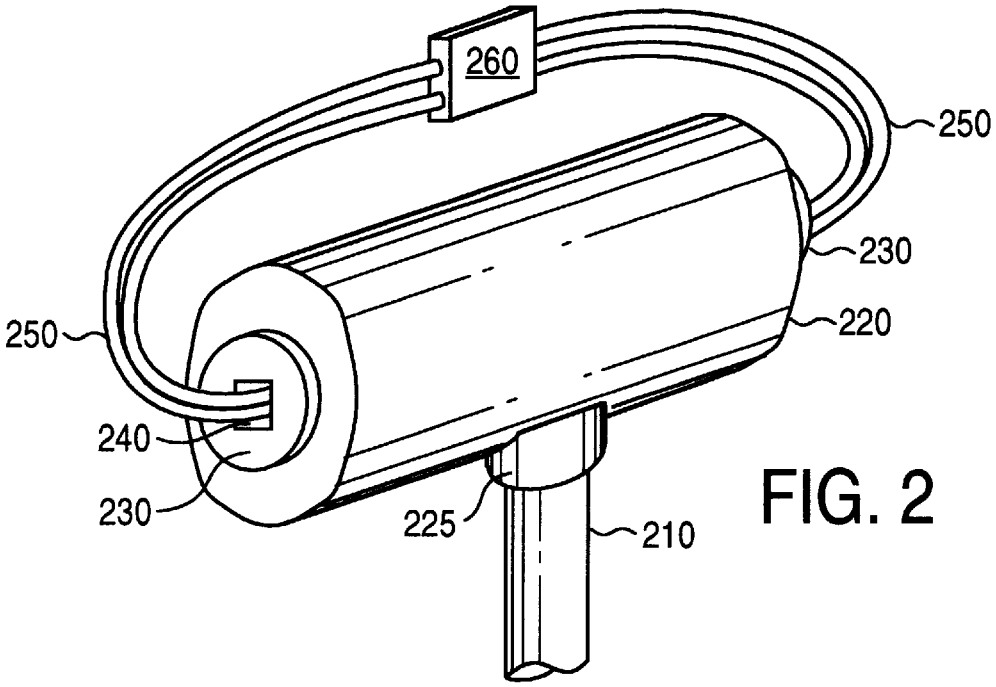
FIG. 2 is a perspective view of one embodiment of the cable connector of the present invention.

FIG. 2 is an illustration of the perspective view of one embodiment of the cable connector of the present invention. A cable 210 is terminated by a cable terminator 200. For one embodiment, the cable terminator 200 has a body 220 that is substantially cylindrical in shape. The cable terminator 200 includes a cable input annulus 225, into which the cable 210 is coupled. For one embodiment, the cable input annulus 225 is located at the center of the body of the cable terminator 200. The cable terminator 200 further includes an pivot 230 on either end of the cable terminator 200. The pivot 230 is sufficiently smooth in shape to permit rotation within a mating housing. For one embodiment, the pivot 230 is circular in shape.

Wires 250 extend from the hole 240 in the pivot 230. The wires 250 are coupled to the cable 210 within the cable terminator 200. For one embodiment, the wires 250 are the wires of the cable, without the cable casing. The wires 250 are coupled to a connecting piece 260. The connecting piece 260 is designed to be coupled to a socket in a device, when the cable terminator 200 is mated into a mating housing of the device (not shown). For one embodiment, the connecting piece 260 is coupled to a printed circuit board socket. Although only four wires 250 are illustrated in FIG. 2, it is understood that more wires 250 may be used. Wires 250 are shown extending from both sides of the cable terminator 200 in FIG. 3. In an alternative embodiment, wires 250 may extend from only one side of the cable terminator 200.

For one embodiment, the body 220 and pivot 230 are molded plastic. For one embodiment, the body 220 and pivot 230 are solid, molded around the cable 210 and the wires 250. For an alternative embodiment, the pivot 230 has a hole 240 in it, the cable terminator 200 is hollow, and the hole 240 in the pivot 230 creates a bore through the cable terminator 200. For one embodiment, the hole is circular in shape. Alternatively, the hole may be square, or any other shape.

Figure 3:
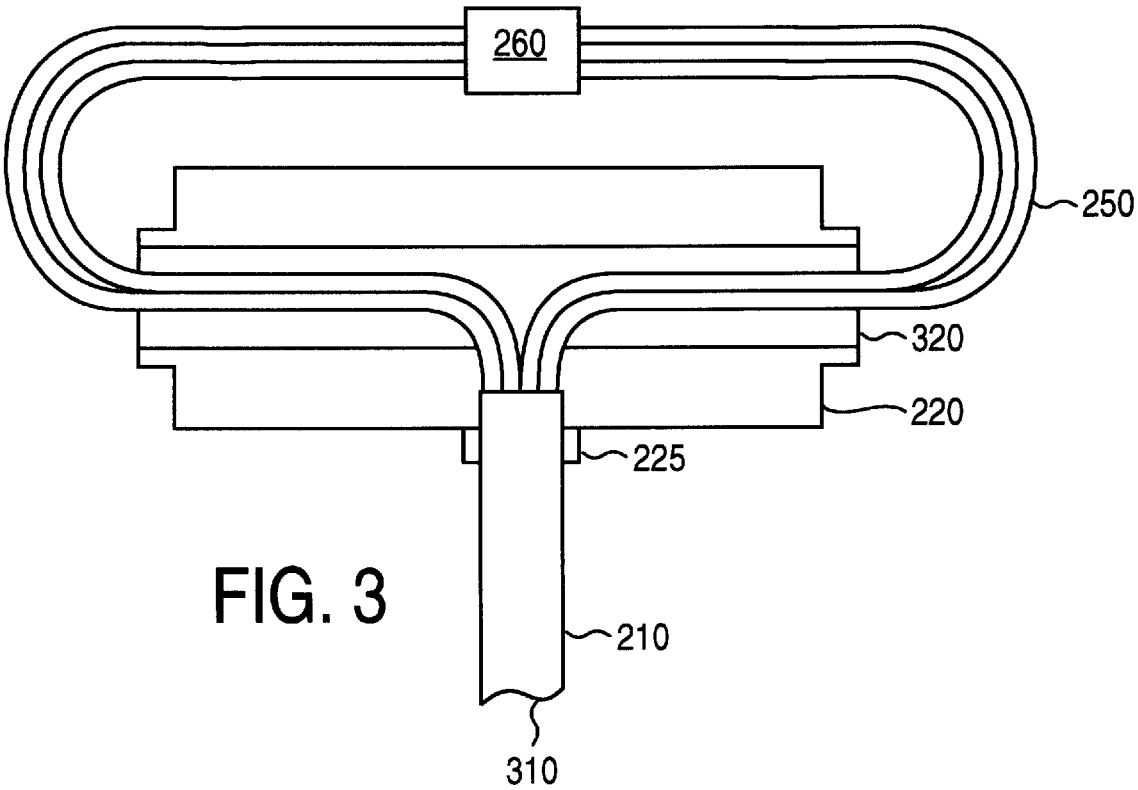
FIG. 3 is a sideways view of the interior of connector of FIG. 2.

FIG. 3 is a side view of the interior of cable terminator 200 of FIG. 2. The cable terminator 200 is shown cut in half along its length. For one embodiment, the interior of the cable terminator 200 has a cavity 320 along its length, terminating in the holes 240 in the pivots 230. For an alternative embodiment, the body 220 is solid. For one embodiment, the cable terminator 200 is hard plastic.

The cable 210, including a cable casing 310, is coupled into the cable terminator 200. The cable 210 includes a plurality of wires 250, which are enclosed by a cable casing 310. The cable casing 310 of the cable 210 is removed from the end of the cable 210 that within the body 220 of the cable terminator 200. The plurality of wires 250 within the cable 210 are then lead out of the cable terminator 200 through the pivots 230. For one embodiment, the wires 250 come out of the cable terminator 200 along the axis of rotation of the cable terminator. This reduces the amount of movement experienced by the wires 250 when the cable terminator 200 is rotated. For one embodiment, the number of wires 250 is divided between the holes 240 on either side of the cable terminator 200. Alternatively, the wires 250 may exit through only one hole 240.

Figure 4:
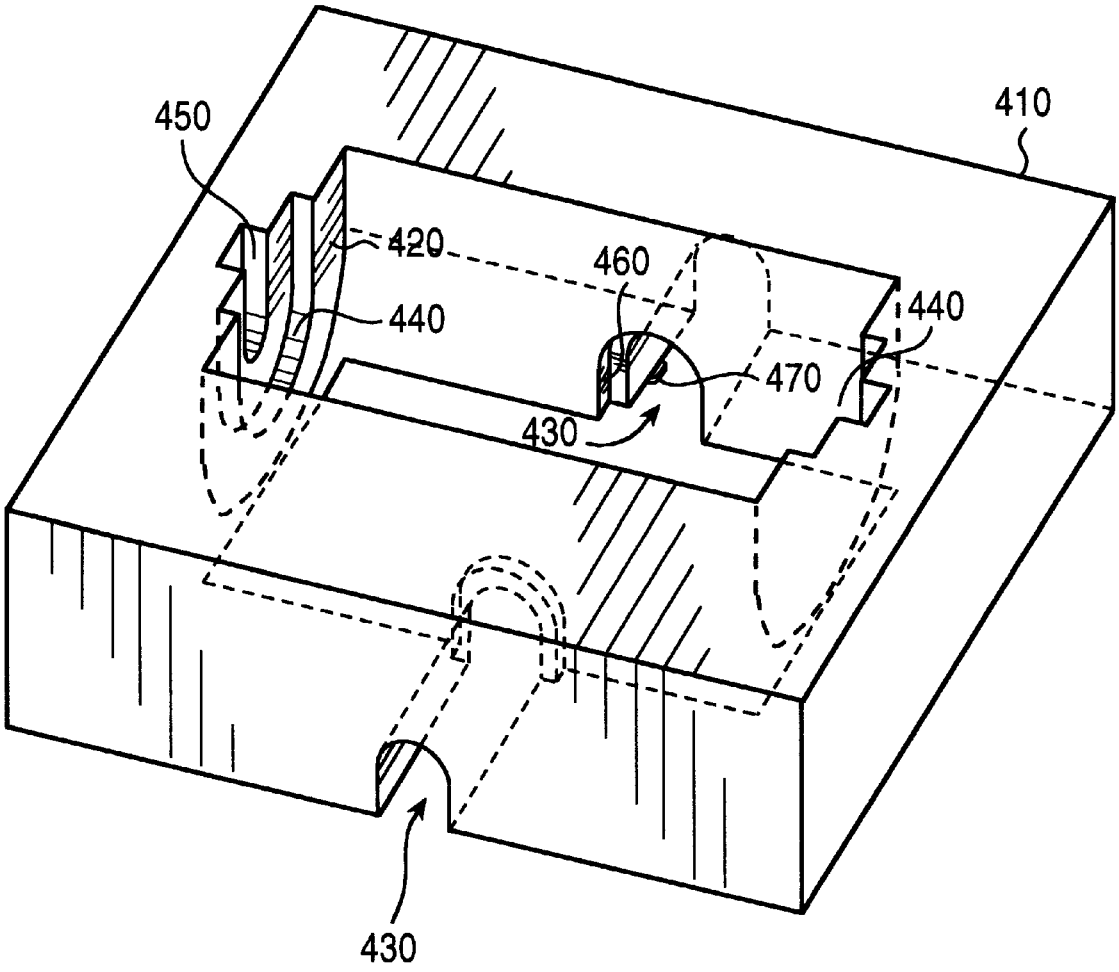
FIG. 4 is a perspective view of one embodiment of the mating housing into which the cable connector is inserted.

FIG. 4 is a perspective view of one embodiment of the mating housing into which the cable terminator 200 is inserted. The device 410 which is to have a cable connected to it includes a mating housing 400. The mating housing 400 is designed to fit a cable terminator 200, such as the one illustrated in FIG. 2. The mating housing includes a main chamber 420 for receiving the body of the cable terminator 200. For one embodiment, the main chamber 420 is U-shaped, with two ends . For one embodiment, the main chamber 420 is slightly larger than the cable terminator 200, such that the cable terminator 200 snugly fits into the main chamber 420. The main chamber 420 opens from within the device. Thus, the cable terminator 200 is inserted into the main chamber 420, and the device is closed, enclosing the cable terminator 200, leaving the cable extended from the cable terminator 200.

The mating housing 400 further includes two grooves 430 on either side of the main chamber 420, for the cable 210. The grooves 430 are aligned such that they are in a straight line. Each groove 430 is substantially U-shaped, and sized such that the cable fits entirely within the groove 430. For one embodiment, the groove 430 includes small latches 470, for securing the cable 210 within the groove 430.

The end of the groove 430 which is adjacent to the main chamber 420 includes a larger depression 460. The depression 460 is shaped to fit the annulus 225 of the cable terminator 200. Thus, the cable fits into the groove 430, while the annulus connecting the cable to the cable terminator 200 fits into depression 460. Since the cable may be fitted in either groove, the depression 460 is present at the end of both of the grooves 460.

The mating housing 400 further includes two concavities 450 on the ends of the chamber 420, one on each end. The concavities 450 are aligned in a straight line. The concavities 450 are substantially U-shaped, with a smooth texture. The concavities 450 are designed to fit the pivots 230 of the cable terminator 200, and permit rotation of the cable terminator 200 within the mating housing 400. For one embodiment, the concavities 450 are of a different material, which is slippery, to permit smoother rotation of the pivots 230. For one embodiment, each concavity 450 further includes a hole 450, for permitting the wires extending from the cable terminator 200 to extend from the mating housing. Alternatively, the each concavity 450 may include a connection area, which is in electrical contact with the device 410. Note that this illustration only illustrates the mating housing 400 for receiving the cable terminator 200, and does not show the device itself to which the cable is electrically coupled.

For one embodiment, the mating housing 400 illustrated is in the bottom of a device 410. For one embodiment the main chamber 420 is designed such that when the cable terminator 200 is disposed within the mating housing 400, and the cable is disposed within the groove 430, neither the cable nor the cable terminator extend beyond the mating housing 400. Therefore, the mating housing 400 may be located on the base of the device 410 without affecting the device 410.

Figure 5A:
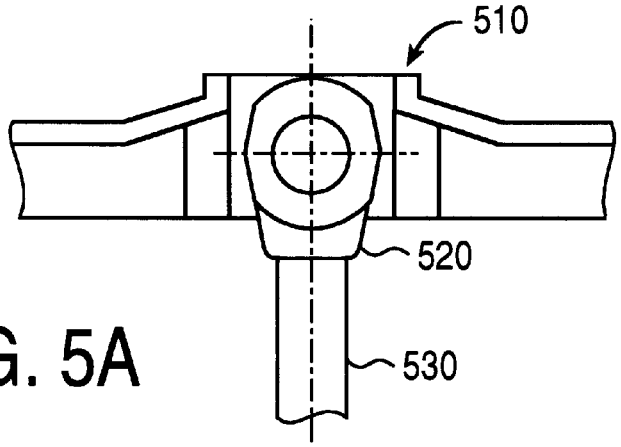
FIG. 5A is a cut-out view of the connector in the mating housing.

FIG. 5A is a cut-out view of the cable terminator 200 in the mating housing, extending down. The mating housing 510 is in the bottom of a device, and includes a right cable groove 540 and left cable groove 545, for receiving the cable 530. The cable terminator 520, and the cable 530 attached to the cable terminator 520 extend from the mating housing 510. For one embodiment, the cable terminator 520 extends perpendicularly from the mating housing 510, when the cable 530 is not within the cable groove 545.

Figure 5B:
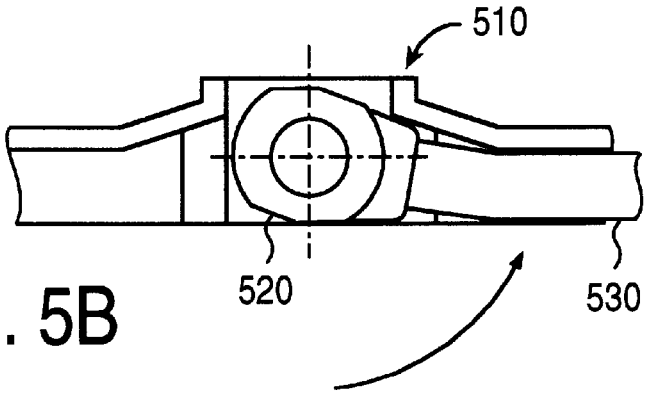
FIG. 5B is a cut-out view of the connector placed in the mating housing and connected in one direction.

FIG. 5B is a cut-out view of the cable terminator 520 in the mating housing and rotated in one direction. The cable terminator 520 in the mating housing 510 is rotated to the right, such that the cable terminator 520 lays sideways, at almost a 90 degree angle, and the cable 530 fits within the right cable groove 540.

Figure 5C:
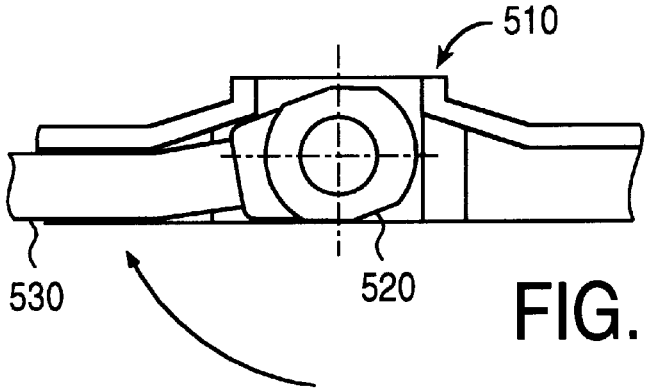
FIG. 5C is a cut-out view of the connector place in the mating housing and connected in the other direction.

FIG. 5C is a cut-out view of the cable terminator 520 in the mating housing and rotated in the other direction. The cable terminator 520 in the mating housing 510 is rotated to the left, such that the cable terminator 520 lays sideways, at almost a 90 degree angle, and the cable 530 fits within the left cable groove 545. As can be seen in FIGS. 5B and 5C, once connected, neither the cable terminator 520 nor the cable 530 extend beyond the bottom of the cable terminator 520. This permits the location of the mating housing 510 in the base of a device.

Figure 6:
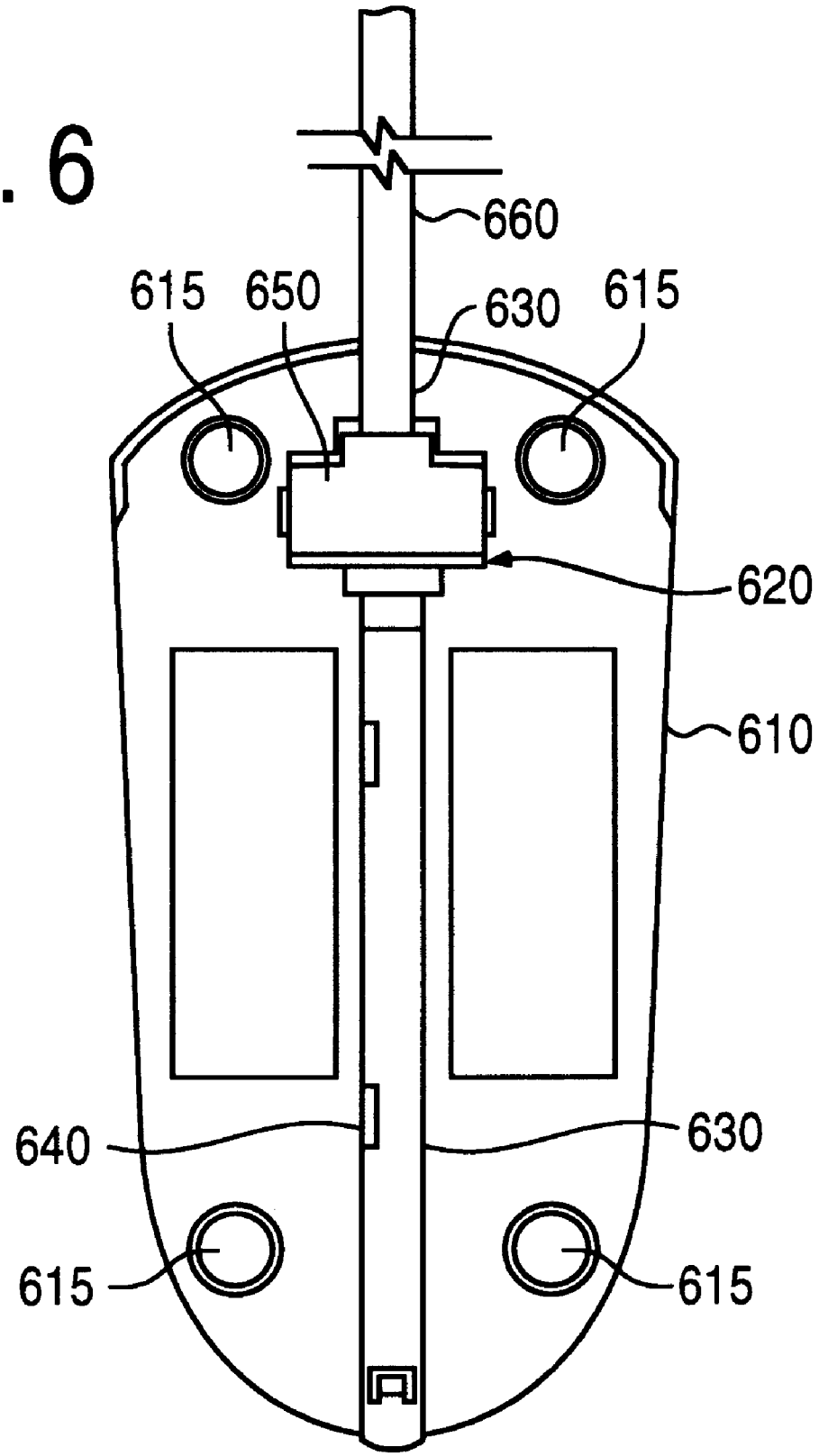
FIG. 6 is a bottom view of the device including the mating housing and cable connection.

FIG. 6 is a bottom view of one embodiment of a device including the mating housing and cable connection. Note that this is only one example of a device in which the connection system of the present invention may be incorporated. The device 610 bottom includes a mating housing 620 for fitting a cable terminator 650 and cable 660. The device bottom 610 may further include feet 615, to elevate the device. This may be useful if the cable terminator 200 650 or the cable 660 slightly extend beyond the mating housing 620 and groove 630 respectively. The groove 630 further includes latches 640, for securing the cable 660 within the groove 630. In this instance, the illustration shows the cable 660 extending in the upward direction. However, it is understood that the cable 660 could alternately extend in the downward direction.

Figure 7:
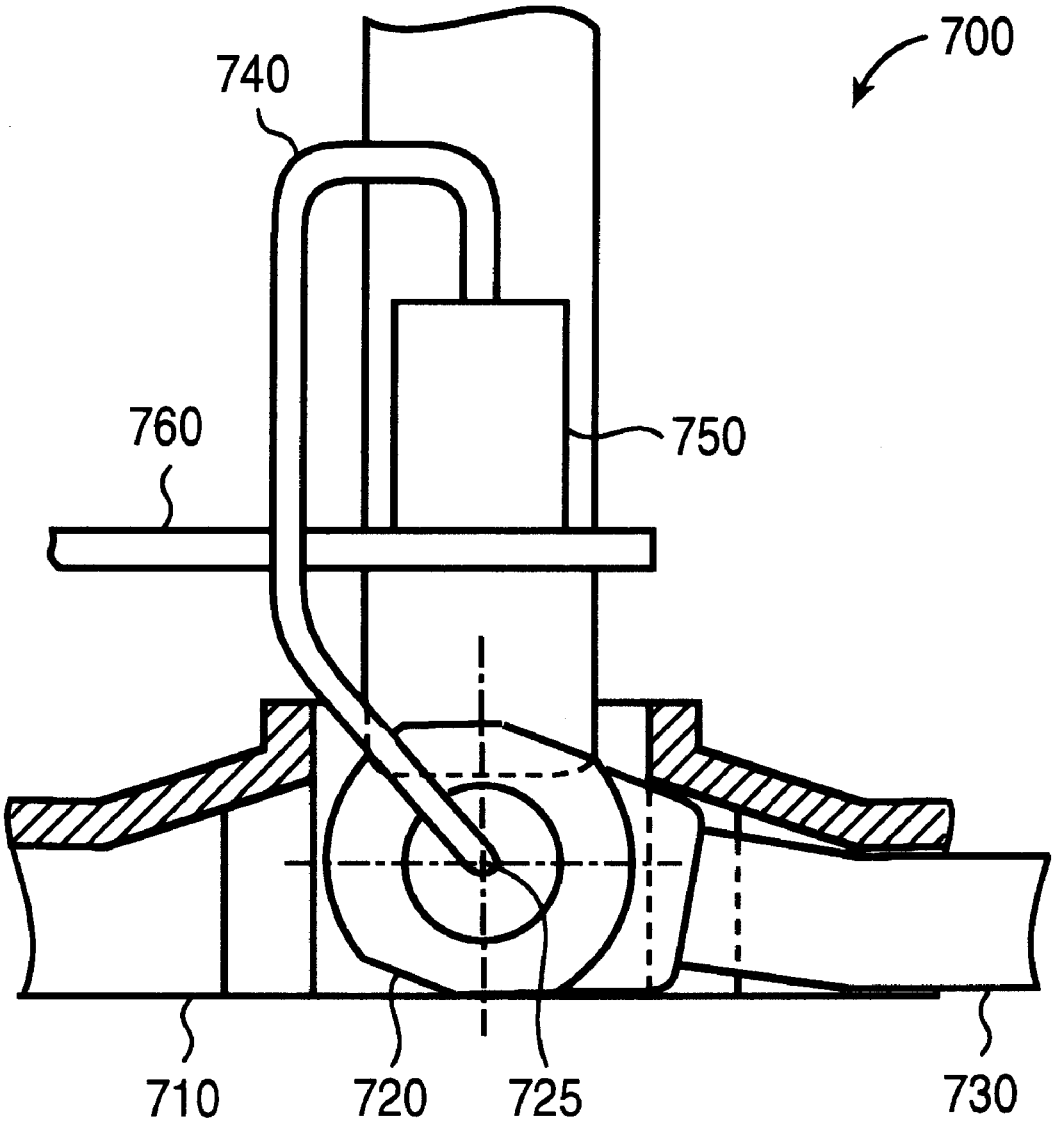
FIG. 7 is a cut-out view of one embodiment of the connector portion of the present system as connected to a device.

FIG. 7 is a cut-out view of one embodiment of the cable terminator 200 portion of the present system as connected to a device. The previous figures illustrate the cable terminator 200 and the mating housing. However, the interaction of the connecting piece 260, illustrated in FIG. 2 is not described. FIG. 7 shows a cross section of the entire system 700. The mating housing 710 is in the base of the device (not shown). The cable 730 is terminated by the cable terminator 720 which is inserted into the mating housing 710. The cable 730 is disposed within the cable groove 770. There is a hole 725 in the pivot 770 of the cable terminator 200 720, through which the wires 740 which are part of the cable 730 are threaded. The wires 740 are coupled to a connecting piece 750. The connecting piece 750 is connected to a printed circuit board 760 or similar component of the device. For one embodiment, the connecting piece 750 is connected to a receiving mating housing 760 of the device. Because the wire 740 is flexible, the cable terminator 200, 720 may be rotated within the mating housing 710.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. The present invention should not be construed as limited by such embodiments and examples, but rather construed according to the following claims.

What is claimed is:

1. A cable termination to mechanically couple a cable to a mating housing in a device, the cable termination comprising:

a body suited for rotating within the mating housing, the body receiving the cable;

two substantially circular pivots aligned to each other and coupled along a rotational axis of the body, the pivots fitting into the mating housing such that the body is rotatably disposed within the mating housing; and wires output from the body, the wires substantially on the rotational axis of the body, for electrically coupling the cable to a socket on a printed circuit board in the device.

2. The cable termination of claim 1, wherein the pivots are integral with the body.

3. The cable termination of claim 2, wherein the body of the cable termination and the pivots are plastic.

4. The cable termination of claim 1, wherein the cable further comprises a plurality of wires in a cable casing, and wherein the wires comprise the wires which are part of the cable.

5. The cable termination of claim 1, further comprising a connecting element for coupling the wires to the device.

6. The cable termination of claim 5, wherein the wires are flexible, such that when the connecting element is coupled to the device the body may be rotated without placing stress on the wires, the cable, or the connecting element.

7. The cable termination of claim 1, wherein the body is substantially cylindrical.

8. The cable termination of claim 1, wherein when the body of the cable termination is rotated into the mating housing, the cable termination does not extend beyond the mating housing.

9. The cable termination of claim 1, the body of the cable termination is solid plastic molded around the wires and the cable.

10. The cable termination of claim 9, wherein when the body of the cable termination is rotated into the mating housing the cable is disposed within a groove, such that neither the cable nor the cable termination extend beyond the mating housing.

11. A device comprising:

a mating housing for receiving a cable terminated by a cable termination, the mating housing including:

a chamber for receiving a body of the cable termination;

a first concavity positioned on one of the two parallel ends, and a second concavity positioned on the other of the two parallel ends, such that the first and the second concavities are aligned in a straight line, the concavities for receiving pivots of the cable termination to rotatably couple the cable termination to the mating housing;

a cable groove for receiving the cable;

wherein the chamber and the cable groove are sized such that neither the cable termination nor the cable extend beyond the cable groove and the chamber when the cable termination is rotated into the mating housing.

12. The device of claim 11 further comprising a socket for electrically coupling the cable to the device.

13. The device of claim 12 further comprising a printed circuit board including the socket.

14. The device of claim 11 wherein the mating housing is disposed in a bottom of the device.

15. A system comprising:

a cable;

a cable termination coupled to the end of the cable, the cable termination including:

a substantially cylindrical body and two substantially circular pivots;

a cable input in the body of the cable termination, for receiving the cable; and a connecting element for coupling the cable to another device, the connecting element coupled to the cable through at least one of the two substantially circular pivots of the cable termination; and a device having a mating housing for receiving the cable termination in a rotatable manner, the cable termination rotating around the circular pivots, and the device having a trough on both sides of the mating housing for fitting the cable in two opposite directions;

the device including a cable groove for receiving the cable;

wherein the mating housing and the cable groove are sized such that neither the cable termination nor the cable extend beyond the cable groove and the chamber when the cable termination is rotated into the mating housing.

16. The system of claim 15 wherein the connecting element comprises:

a wiring coupled to the cable and exiting through a hole in the substantially circular ends of the cable termination;

the wiring coupled to the connection piece, such that the connection piece is flexibly coupled to the cable termination.

17. The system of claim 15, wherein the body of the cable termination and the pivots are integrally molded plastic.

18. The system of claim 15, wherein the cable further comprises a plurality of wires in a cable casing, and wherein the wires comprise the wires which are part of the cable.

19. The system of claim 15, wherein when the connecting element is coupled to the device the body may be rotated without placing stress on wires in the cable, the cable, or the connecting element.

20. The system of claim 15, further comprising a printed circuit board including a socket for electrically coupling the cable to the device.

* * * * *